US011840881B2

(12) United States Patent
Dintheer et al.

(10) Patent No.: US 11,840,881 B2
(45) Date of Patent: Dec. 12, 2023

(54) FINGER PROTECTION DEVICE

(71) Applicant: Planet GDZ AG, Tagelswangen (CH)

(72) Inventors: Andreas Dintheer, Illnau (CH); Andreas Brändle, Hettlingen (CH)

(73) Assignee: ASSA ABLOY (Schweiz) AG, Richterswil (CH)

( * ) Notice: Subject to any disclaimer, the term of this patent is extended or adjusted under 35 U.S.C. 154(b) by 428 days.

(21) Appl. No.: 16/640,937

(22) PCT Filed: Jul. 31, 2018

(86) PCT No.: PCT/EP2018/070646
§ 371 (c)(1),
(2) Date: Feb. 21, 2020

(87) PCT Pub. No.: WO2019/038030
PCT Pub. Date: Feb. 28, 2019

(65) Prior Publication Data

US 2021/0123299 A1 Apr. 29, 2021

(30) Foreign Application Priority Data

Aug. 23, 2017 (EP) ..... 17187424

(51) Int. Cl.
*E06B 7/00* (2006.01)
*E06B 7/36* (2006.01)

(52) U.S. Cl.
CPC ..... *E06B 7/367* (2013.01)

(58) Field of Classification Search
CPC ..... E06B 7/367; E06B 3/32
USPC ..... 49/383, 384, 462; 242/596.1, 596.8
See application file for complete search history.

(56) References Cited

U.S. PATENT DOCUMENTS

| | | | | |
|---|---|---|---|---|
| 1,444,398 | A | 2/1923 | Shepherd | |
| 1,894,102 | A | 1/1933 | Kuenzel | |
| 4,694,559 | A * | 9/1987 | Lundy | B65H 75/242 29/559 |
| 5,662,288 | A * | 9/1997 | Chiang | A47K 10/38 242/596.8 |
| 6,761,298 | B1 * | 7/2004 | Cantrell | B65H 35/002 242/596.1 |
| 7,082,983 | B2 | 8/2006 | Coulibaly et al. | |

(Continued)

FOREIGN PATENT DOCUMENTS

| | | | |
|---|---|---|---|
| CN | 201170043 | A | 12/2008 |
| CN | 104790791 | A | 7/2015 |

(Continued)

*Primary Examiner* — Daniel J Troy
*Assistant Examiner* — Daniel Alvarez
(74) *Attorney, Agent, or Firm* — The Webb Law Firm

(57) ABSTRACT

A finger protection device for bridging a gap of a door or window that has a winding shaft with a first end face and a second end face and a roller blind web that can be wound via the winding shaft. The roller blind web is arranged with a first end on the winding shaft and on the winding shaft side can be attached, together with the winding shaft, to a first part of the opening. The roller blind web can be attached with a second free end to a part of the opening. The finger protection device has a first and a second holder, wherein the first holder arranged on the first end face of the winding shaft and the second holder is arranged on the second end face of the winding shaft.

14 Claims, 8 Drawing Sheets

(56) References Cited

U.S. PATENT DOCUMENTS

| | | | | |
|---|---|---|---|---|
| 8,167,230 | B2 * | 5/2012 | McLawhorn | A61F 2/0063 242/402 |
| 10,513,880 | B2 | 12/2019 | Dintheer et al. | |
| 10,619,414 | B2 * | 4/2020 | Ng | E06B 9/50 |
| 10,934,775 | B2 * | 3/2021 | Zhang | E06B 9/322 |
| 11,332,973 | B2 * | 5/2022 | De Vries | E06B 9/60 |
| 2010/0162630 | A1 | 7/2010 | Shim | |
| 2014/0075871 | A1 * | 3/2014 | Haan | E06B 1/00 52/309.1 |
| 2019/0277084 | A1 | 9/2019 | Dintheer et al. | |

FOREIGN PATENT DOCUMENTS

| | | | | | |
|---|---|---|---|---|---|
| CN | 106894710 | A | | 6/2017 | |
| DE | 297647 | | | 5/1917 | |
| DE | 3716654 | A1 | | 12/1988 | |
| DE | 202008016094 | U1 | | 4/2009 | |
| DE | 202011101026 | U1 | | 2/2012 | |
| DE | 102014118748 | A1 | | 6/2016 | |
| DE | 202015102877 | U1 | | 10/2016 | |
| DE | 102015108765 | A1 | | 12/2016 | |
| DE | 202016106174 | U1 | | 1/2017 | |
| EP | 1329349 | A1 | | 7/2003 | |
| EP | 3144462 | A1 | | 3/2017 | |
| GB | 2164690 | A | * | 3/1986 | E06B 7/367 |
| GB | 2164690 | B | | 7/1988 | |
| KR | 19980028250 | U | | 8/1998 | |
| KR | 200323394 | Y1 | | 8/2003 | |
| KR | 1020090069396 | A | | 7/2009 | |
| WO | 2017036679 | A1 | | 3/2017 | |

* cited by examiner

FINGER PROTECTION DEVICE

CROSS-REFERENCE TO RELATED APPLICATIONS

This application is the United States national phase of International Application No. PCT/EP2018/070646 filed Jul. 31, 2018, and claims priority to European Patent Application No. 17 187 424.1 filed Aug. 23, 2017, the disclosures of which are hereby incorporated by reference in their entirety.

BACKGROUND OF THE INVENTION

Field of the Invention

The present invention relates to a finger protection device for doors and windows.

Description of the Related Art

Doors harbor an increased risk of accident, in particular for small children. Fingers become trapped between the door frame and the pivotable door leaf again and again. The forces acting on the trapped fingers, in this case, are great and the resultant injury can be correspondingly serious.

The prior art consequently discloses devices which are to provide protection against unintentionally trapping fingers. In one solution variant, the gap between the secondary closing edge of the pivotable door leaf on the side opposite the hinge side and the door frame is covered by way of a textile protective roller blind which is fastened, on one side, to the door frame and, on the other side, to the pivotable door leaf.

Such protective roller blinds are disclosed, for example, in GB 2 164 690B, DE 20 2008 016 094 U1, WO 2017/036679 A1 and DE 20 2016 106 174 U1. The wound roller blind web is situated in each case in a housing which is screw-connected to the door frame or the door leaf.

DE 20 2011 101 026 U1, DE 297 647, DE 20 2015 102 877 U1 and EP 3 144 462 A1 propose to arrange the roller blind web inside a groove of the door frame. In some instances, bringing the roller blind web out through a slot in the door frame is proposed.

Such finger protection roller blinds are additionally used in the case of parallel vent windows and hatches. Such vent windows comprise a building-side sash frame and a window leaf which is movable relative thereto with a leaf frame. Sash frame and leaf frame are connected to one another by means of scissor-like vent fittings. Said scissor-like vent fittings make it possible for the leaf frame to be adjusted outward parallel to itself in relation to the sash frame and thus for the window to be opened by a predefined gap. In the case of hatches, an equally known vent fitting is used between the sash frame and the hatch frame in order to pivot the hatch leaf in relation to the sash frame and thus open the hatch by a predetermined angle.

So that fingers are not able to be trapped in the vent fitting, it is proposed to mount a roller blind on the inside of the window or of the hatch, that is to say on the side of the user. DE 10 2014 118 748 A1 proposes using a roller blind with a rectangular web or in a triangular shape.

The disadvantage of the disclosed finger protection devices is that they are each realized for a specific application, for example for use on a door frame or in grooves of the door trims or sash frames or for parallel vent windows and hatches.

SUMMARY OF THE INVENTION

It is consequently an object of the invention to create a finger protection device which is usable in as diverse a manner as possible.

In a preferred embodiment, the finger protection device according to the invention, for bridging a gap of an opening which is closable by means of a leaf, for example of a door, a window, a gate or a hatch, comprises a winding shaft with an end-face first end and an end-face second end and a roller blind web which is windable about the winding shaft by means of said winding shaft. The roller blind web is arranged by way of a first end on the winding shaft and it is fastenable together with the winding shaft to a first part of the opening on the winding shaft side. The roller blind web is fastenable to part of the opening by way of a free second end. The finger protection device comprises a first and a second holder, wherein the first holder is arranged on the end-face first end of the winding shaft and the second holder is arranged on the end-face second end of the winding shaft, wherein the first and the second holders serve together for fastening the finger protection device on the winding shaft side to the first part of the opening. The wound roller blind web forms an outermost surface, as a result of which the finger protection device is realized to be used without a housing in the first part of the opening.

The first part of the opening is preferably a frame, for example a door trim or a sash frame. The second part of the opening is preferably part of the leaf. It is also possible, for example, to reverse the arrangement i.e. the first part is associated with the leaf.

Doors or windows are mentioned respectively below, wherein this is to be understood as all openings which are closable by way of leaves, in particular building openings and in particular folding doors or windows, sliding doors or windows, parallel vent doors or windows, sliding and hinged gates and hatches in general.

The finger protection device according to the invention does not require a housing to fasten it to a part of the door or of the window on the winding shaft side. The fastening is preferably effected exclusively by means of the two holders which are arranged on the end faces of the winding shaft.

Said device is relatively small and cost-efficient. It can also be arranged on or in a door frame or window frame when space is tight.

As its fastening takes place on both end-face ends of the device, the corresponding fastening means are easily accessible and the device is also simple to assemble in tight spaces.

The device according to the invention can additionally be produced relatively simply in a desired length.

In a simple embodiment, at least one holder is fixedly connected to the winding shaft. However, both holders are preferably realized as parts that are separate from the winding shaft.

In a simple embodiment, one or both holders are fastened by means of screws to the first part of the opening, in particular to or in the door frame or window frame. However, at least one of the holders is preferably arranged so as to be displaceable in a guided manner and preferably both holders are arranged so as to be displaceable in a guided manner. The first holder is preferably displaceable in a guided manner relative to the second holder and is fixable in its position for fastening the finger protection device.

A rail is preferably present for this purpose, in which rail at least the first holder is displaceable in a guided manner relative to the second holder.

The second holder is also preferably displaceable in a guided manner in the rail relative to the first holder.

Depending on the embodiment, said rail is fastenable to the first part of the opening or it is an integral component part of the first part of the opening. For example, the door or window area is a profile element which comprises a groove or a cavity for receiving the winding shaft with the wound roller blind web, wherein a guide for the holder is realized on a wall or in the cavity. Said guide is preferably a parallel groove which extends along the longitudinal axis of the winding shaft. An intermittent guide can also be used in place of a continuous guide. In particular, the rail or the parallel groove is arranged in two parts and just in the region of the first and second holder.

The winding shaft is preferably held in a clamped manner between the first and the second holder. As a result, the finger protection device can be fixed in its position with a minimum of screws or other fixing means.

In a preferred embodiment, the first and/or the second holders comprise a base plate each for abutment against the winding shaft and a leg each which is arranged at an angle on the base plate for fastening to the first part of the opening. Said holders are easy to produce and do not require much space. They are additionally simple to handle.

The base plate preferably comprises a window which forms an access to a spindle of the winding shaft. As a result, the finger protection device cannot be made ready for operation until it is assembled in the door frame or window frame, i.e. the springs of the winding shaft tension and wind up the roller blind. This also makes subsequent adjustment of the winding unit easier.

In a preferred embodiment, the first and/or the second holders are displaceable along a longitudinal groove or another type of guide in order to clamp the winding shaft between them. The longitudinal groove is preferably a parallel groove which extends in the longitudinal direction of the winding shaft.

The longitudinal groove is preferably arranged in a rail and the leg of the first and/or the second holder is guided so as to be displaceable in the longitudinal groove.

In a preferred embodiment, both holders can be displaced relative to the rail or to their guide. In a simpler embodiment, one of the two holders is fixedly connected to the rail, is preferably realized in one piece with said rail, and just the second holder is able to be displaced in a guided manner relative to the rail.

In a simple embodiment, the holders form end-face covers for the winding shaft which is otherwise realized open at the end face. In preferred embodiments, however, the winding shaft comprises its own cover on at least one end face, wherein one of the two holders encompasses said cover. The winding shaft preferably comprises a cover on each of the two end faces, wherein each one of the two holders encompasses each one of the two covers. As a result, the winding unit including restoring springs can be used as an at least partially closed module without there being the risk, when assembling it on the door or on the window, of individual parts of the winding unit falling out.

The respective holder preferably encompasses the respective cover in a non-rotatable manner. If the roller blind web becomes unwound from the winding shaft or wound onto the same, the cover is consequently not able to be entrained thanks to the fixing by the holder which is also already fixed on or in the door frame or window frame. Said non-rotatable or rotationally fixed bracket also facilitates assembly.

The respective holder preferably comprises an at least partially circumferential apron for encompassing the respective cover. The holder is realized, as a result, in a simple and cost-efficient manner but fulfills the tasks set for it in an optimum manner.

Mentioned below are three further preferred embodiments which, depending on the realization variant, comprise a housing-free roller blind web or are provided with an outside housing.

In a first of said three further preferred embodiments, the finger protection device according to the invention for bridging a gap of an opening which is closable by means of a leaf, for example of a door, a window, a gate or a hatch, comprises a winding shaft and a roller blind web which is windable about said winding shaft by means of the winding shaft, wherein the roller blind web is arranged by way of a first end on the winding shaft and is fastenable together with the winding shaft to a first part of the opening on the winding shaft side. The roller blind web is fastenable to part of the opening by way of a free second end. The finger protection device comprises on the winding shaft side at least one fastening means which is displaceable in a guided manner in or on a rail in a longitudinal direction of the winding shaft and is fixable to the rail for the purposes of fastening the finger protection device on the winding shaft side to the first part of the opening.

The rail preferably comprises a parallel groove and the holder comprises a correspondingly formed tenon block, for example a leg which is receivable in the groove. The arrangement, however, can also be reversed, i.e. the rail realizes a tenon block and the holder comprises a corresponding parallel groove.

The guide in a rail facilitates assembly in a desired position, in particular when the spatial conditions are not favorable for inserting an assembly tool. If the rail is an integral component part of the first part of the opening, e.g. of the door trim or of the sash frame, the position of the finger protection device is thus already predefined in at least two dimensions in space and the finger protection device is unable to be assembled in the wrong manner.

In a simple embodiment, there is only one fastening means present. However, preferably at least two, in an even more preferred manner precisely two fastening means are present. These are preferably the holders mentioned and described above.

In another preferred embodiment, the finger protection device according to the invention for bridging a gap of an opening which is closable by means of a leaf, for example of a door, a window, a gate or a hatch, comprises a winding shaft with an end-face first end and an end-face second end and a roller blind web which is windable about said winding shaft by means of the winding shaft. The roller blind web is arranged by way of a first end on the winding shaft and is fastenable together with the winding shaft to a first part of the opening on the winding shaft side. The roller blind web is fastenable to part of the opening by way of a free second end. The finger protection device comprises at least one first and one second holder, wherein the first holder is arranged on the end-face first end of the winding shaft and the second holder is arranged on the end-face second end of the winding shaft. The finger protection device additionally comprises a rail in which the first and the second holders are displaceable in a guided manner and are fixable in their position in order to clamp the winding shaft with the wound roller blind web between the two holders and, as a result, to fasten it to the first part of the opening.

Said rail enables simple clamping and holding of the winding shaft with its wound roller blind web. The fastening is simple. The rail can be a separate part, wherein it can be fastened in a space-saving manner on or in the door frame or window frame. It can, however, also be an integral component part of the frame and consequently predefine the position of the assembly.

In a third embodiment, the finger protection device according to the invention for bridging a gap of an opening which is closable by means of a leaf, for example of a door, a window, a gate or a hatch, comprises a winding shaft with an end-face first cover and an end-face second cover and a roller blind web which is windable about said winding shaft by means of the winding shaft. The roller blind web is arranged by way of a first end on the winding shaft and is fastenable to a first part of the opening on the winding shaft side together with the winding shaft. The roller blind web is fastenable to part of the opening by way of a free second end. The finger protection device comprises at least one first and one second holder, wherein the first and the second holders comprise one leg each for fastening to the first part of the opening and wherein the first holder encompasses the first cover of the winding shaft in a non-rotatable manner and the second holder encompasses the second cover in a non-rotatable manner. The winding shaft is held in a clamping manner with the wound roller blind web between the first and the second holders in order to fasten the winding shaft to the first part of the opening.

Said clamping mounting simplifies assembly. In a first embodiment, the holders can be fixedly screwed on or in the door frame. However, at least one of the holders is preferably guided so as to be displaceable in a rail and is fixable in said rail.

BRIEF DESCRIPTION OF THE DRAWINGS

Preferred embodiments of the invention are described below by way of the drawings which serve purely for explanation and are not to be seen as limiting. The drawings are as follows.

Identical parts are provided with identical reference symbols.

DESCRIPTION OF PREFERRED EMBODIMENTS

Figure 1:
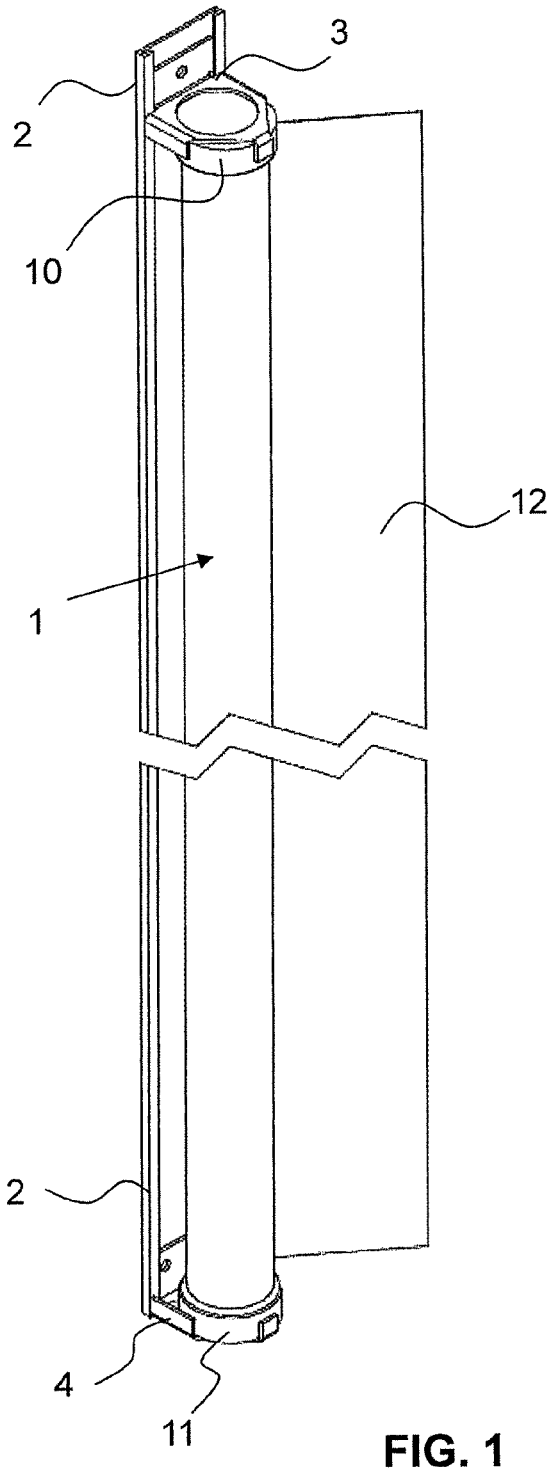
FIG. 1 shows a perspective representation of a first embodiment of the finger protection device according to the invention.

FIGS. 1 to 4 show a first exemplary embodiment of the finger protection device according to the invention. A winding roller 1, formed at least by a winding shaft with a restoring spring and a roller blind web 12 wound at least in part onto the winding shaft, is provided in each case at its upper and lower end-face end with a cover 10, 11. The covers 10, 11 are situated spaced from the roller blind web 12 so that said roller blind web can be wound onto the winding shaft between the covers 10, 11. Such winding rollers 1 are known and are shown, for example, in GB 2 164 690. The roller blind web 12 is preferably produced from a textile material. The two covers 10, 11 are preferably produced from plastics material or metal, in particular aluminum.

A first end of the roller blind web 12 is fastened to the winding shaft, a second free end of the roller blind web 12 can be fastened with known fastening means to the door leaf or window leaf or to another part of an opening, in particular in one of the building openings described in the introduction.

The finger protection device according to the invention additionally includes a rail 2 which extends in the longitudinal direction of the winding roller 1 and consequently of the winding shaft. In addition, a first holder 3 and a second holder 4 are present. The rail 2 and the two holders 3, 4 are preferably produced from metal, in particular from aluminum.

Figure 2:
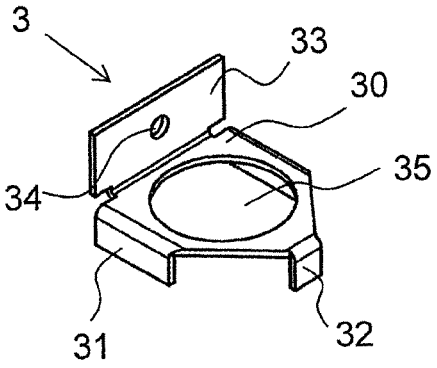
FIG. 2 shows a perspective representation of a first holder according to FIG. 1.

The first holder 3 can be seen well in FIG. 2. It comprises a planar first base plate 30 with two first side wings 31 which are bent downward at right angles and one first front wing 32 which is also bent downward at right angles. At the rear end of the first base plate 30, a first leg 33 is bent at right angles in the opposite direction, that is to say upward. A first fixing bore 34 is present in the first leg 33. The first base plate 30 comprises a window 35, i.e. a through-hole.

Figure 3:
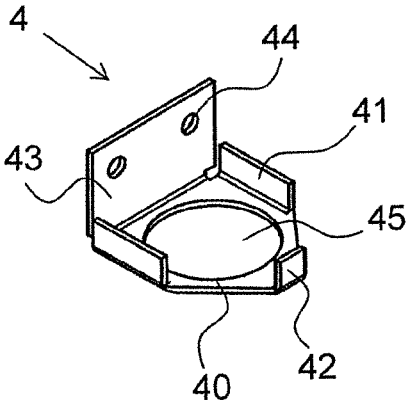
FIG. 3 shows a perspective representation of a second holder according to FIG. 1.

The second holder 4 can be seen well in FIG. 3. It also comprises a planar second base plate 40. There are also present two second side wings 41 which are bent at right angles, one second front wing 42 which is bent at right angles, one second leg 43 and a window 45. The wings 41, 42 and the leg 43 are, however, all bent in the same direction, preferably upward in the direction of the winding roller 1. In addition, there are present two laterally arranged second fixing bores 44 in place of the central first fixing bore 34.

Figure 4:
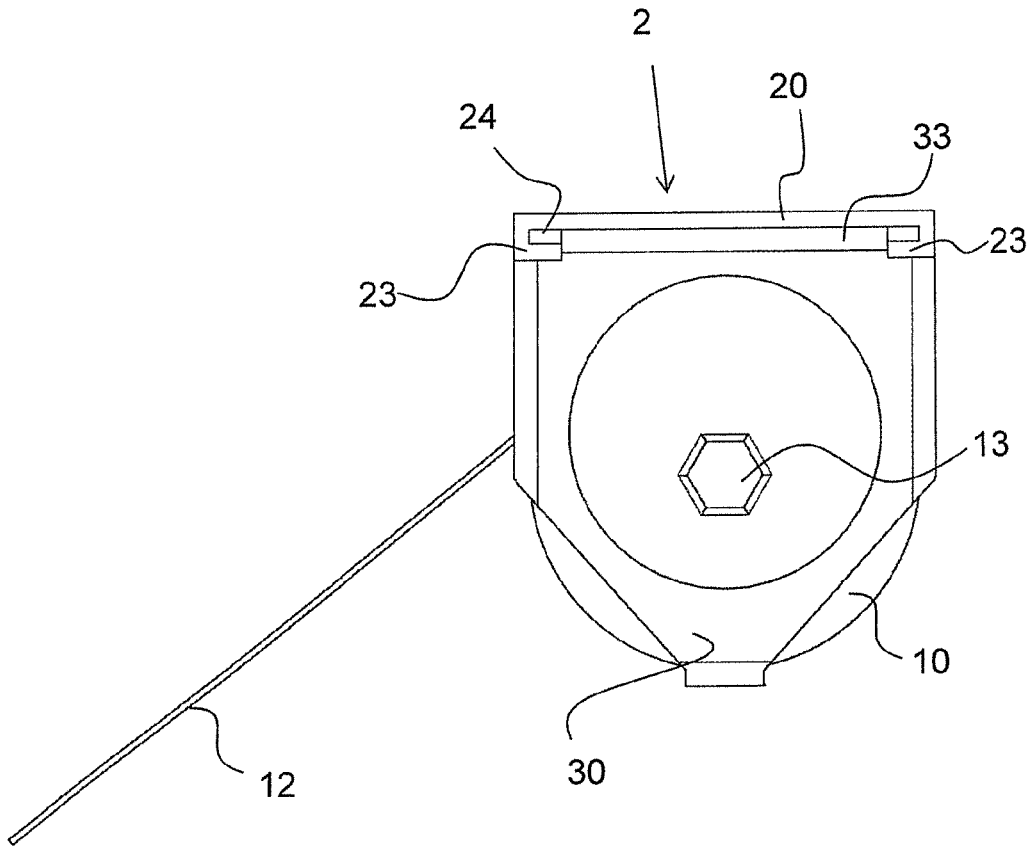
FIG. 4 shows a view from above of the finger protection device according to FIG. 1.

The rail 2, as can be seen well in FIG. 4, comprises a rear wall 20 and two L profile portions 23 which connect thereto and each form a C profile with a connecting part of the rear wall 20. Said region forms a parallel groove 24 which serves as a fastening groove.

As can be seen well in FIG. 1, the first holder 3 abuts by way of its first base plate 30 against an end-face first end, here the upper end of the winding roller 1. More precisely, it abuts against the first cover 10. The second holder 4 abuts correspondingly by way of its second base plate 40 against the opposite end-face second end, here the lower end of the winding roller 1. More precisely, it abuts against the second cover 11.

The side wings 31, 41 and the front wing 32, 42 form an apron which encompasses the respective cover 10, 11. It can be seen in FIG. 8 that the first cover 10, preferably also the second cover 11, comprises a substantially circular or part-circular lateral surface, wherein on at least one side, preferably on two opposite sides, it has a flattening 100. The side wings 31, 41 of the two holders 3, 4 are preferably arranged in the region of said flattening 100 and are preferably also realized in a flattened manner. This enables the covers 10, 11 to be mounted in a non-rotatable, i.e. rotationally fixed, manner by means of the holders 3, 4.

The window 35, 45 enables access to the winding shaft, more precisely to the spring tensioner 13 which, in this example, is accessible from the upper side and can be seen in FIG. 4.

The first and the second holders 3, 4 are held so as to be displaceable in a guided manner with their respective legs 33, 43 in the parallel groove 24 of the rail 2. The holders 3, 4 can preferably be displaced individually and/or they are both displaceable together with the winding roller 1. If the desired position of the winding roller 1 is reached and the winding roller 1 is clamped sufficiently between the two holders 3, 4, the two holders 3, 4 can thus be fixed in their position relative to the rail 2 with fastening screws, which are not shown here and which are screwed onto or into the rail 2 through the fixing bores 34, 44.

As can be seen well in FIG. 1, said device does not comprise an outside housing. The roller blind web 12 is arranged so as to be freely accessible and not in a housing.

Figure 5:
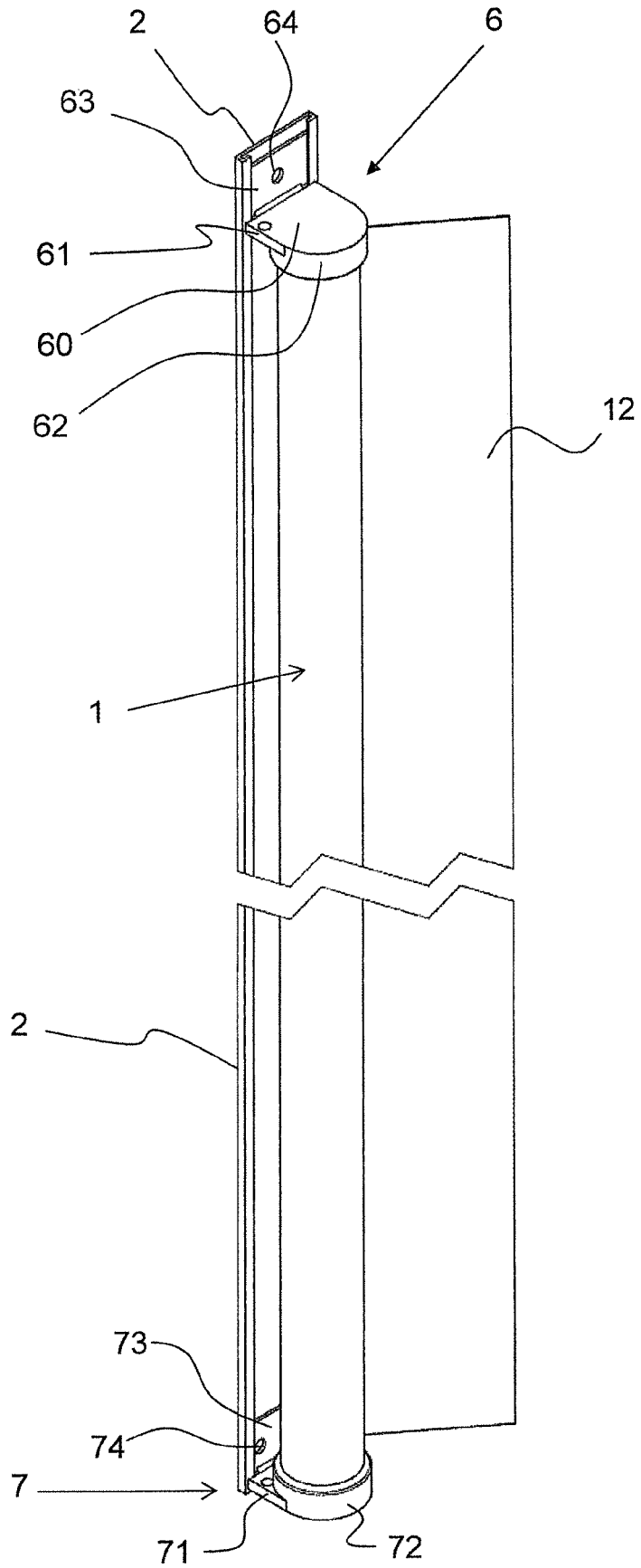
FIG. 5 shows a perspective representation of a second embodiment of the finger protection device according to the invention.

FIG. 5 shows a second embodiment of the device according to the invention. The first holder is provided here with the reference symbol 6 and the second holder with the reference symbol 7. At the same time, they form the covers of the winding roller 1. The legs, which are displaceable in a guided manner in the rail 2, comprise the reference symbols 63 and 73, the corresponding fixing bores the reference symbols 64 and 74. The remaining elements and the assembly of the device are the same as in the preceding example. The winding roller 1, together with its holders 6, 7, consequently forms a module, i.e. an already assembled unit.

Said embodiment can also comprise a through-opening in one or both of the holders/covers in order to rotate the winding shaft and to tension the device. In another variant of said embodiment which is shown here, however, one of the covers/holders 6, 7 is rotated by hand for tensioning the device, whilst the other cover/holder 6, 7 is held firm. This can be obtained, for example, by the winding roller 1 being inserted into the rail 2 with one of the holders 6,7, for example the lower holder 7. The upper holder 6 still projects above the rail 2 and is not yet inserted. By rotating the upper holder 6 the roller blind web 12 can then be wound on and the device tensioned. The upper holder 6 is then also inserted into the rail 2, as a result of which the winding roller 1 is held in its rotational position. The device is now ready for use.

FIGS. 6 to 9 disclose a third exemplary embodiment. The finger protection device is designed substantially the same as in the first example. However, a fastening profile 5, in which the parallel groove 53 which serves as a fastening groove is arranged, is present in place of the flat rail 2.

The fastening profile 5 is, for example, part of a door trim or of a sash frame or it is an attachment element for a door trim or a sash frame. The fastening profile 5 can comprise diverse forms depending on the areas of application. The form shown here is consequently to be understood as simply an example.

The fastening profile 5 shown here is realized in a substantial U-shaped manner. It comprises a rear wall 50, a first side wall 51 which connects thereto and a second side wall 52 which is located opposite the first side wall 51. The named parallel groove 53, in which the first and the second holders 3, 4 are held in a guided manner, is realized on the inside of the rear wall 50 so that the winding roller 1 can be held with the roller blind web 12 in a clamped manner between the holders 3, 4. The fastening profile 5 or the rear wall 50 consequently forms the rail along which the holders 3, 4 are displaceable and on which they are fixable. The parallel groove 53 can be seen well in FIG. 11.

Figure 6:
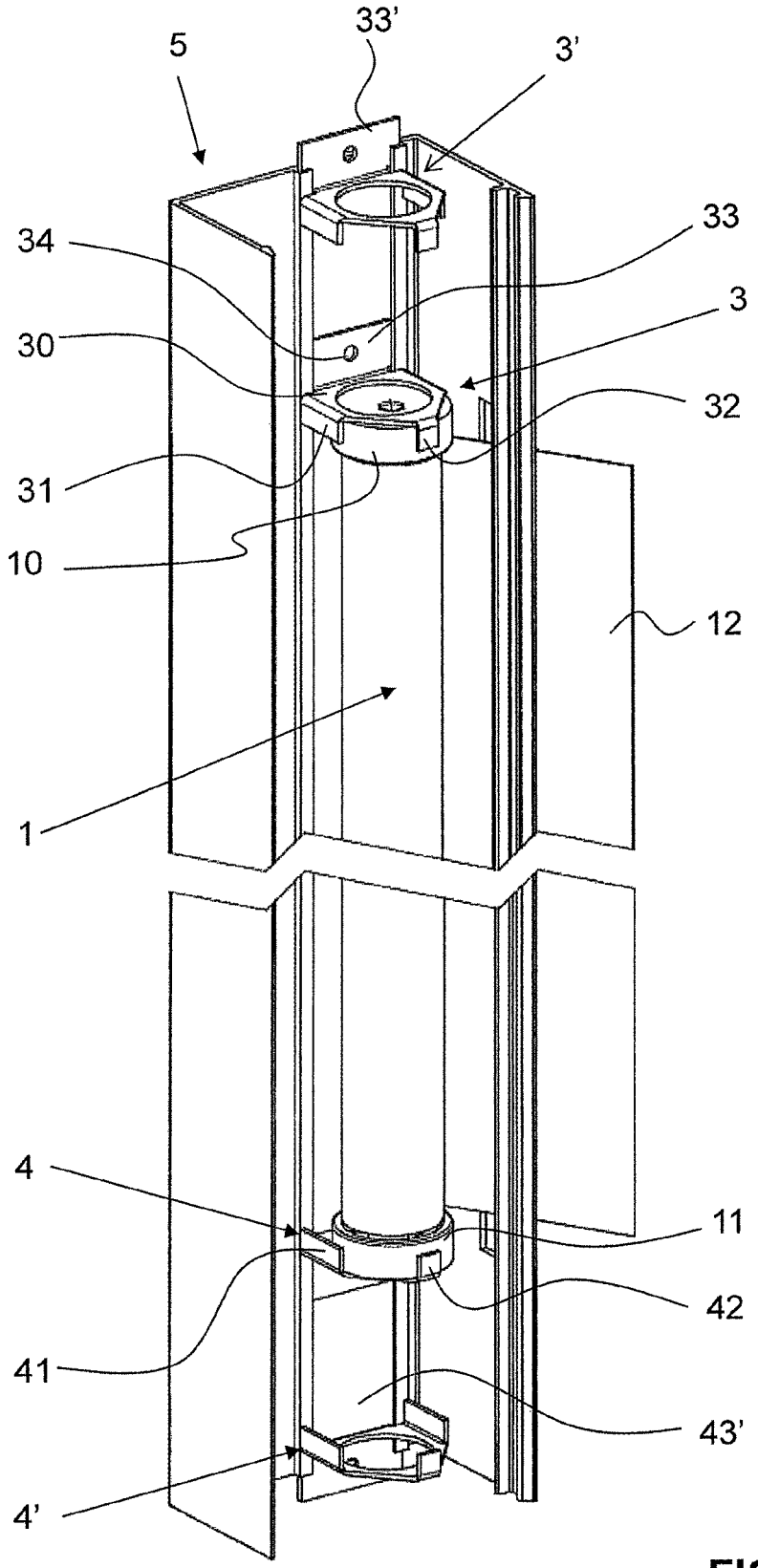
FIG. 6 shows a perspective representation of a third embodiment of the finger protection device according to the invention.
Figure 7:
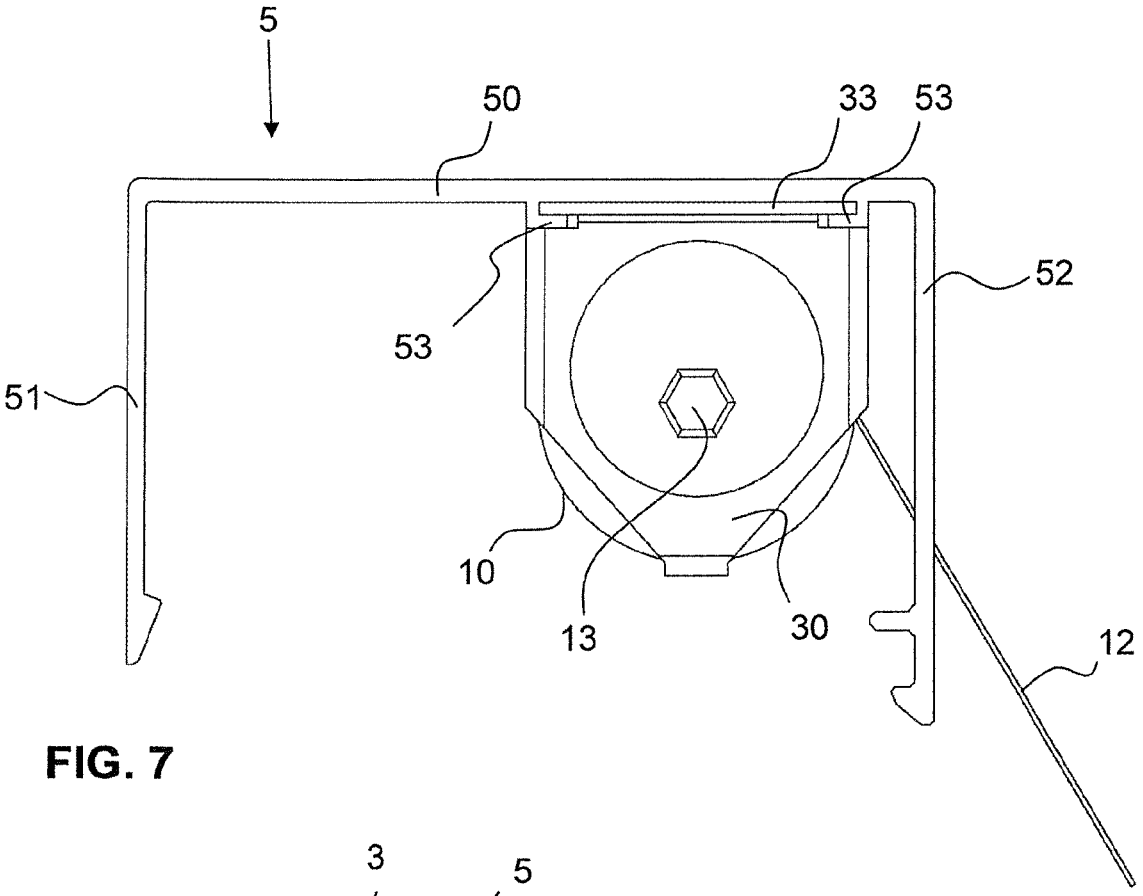
FIG. 7 shows a view from above of the finger protection device according to FIG. 6.
Figure 8:
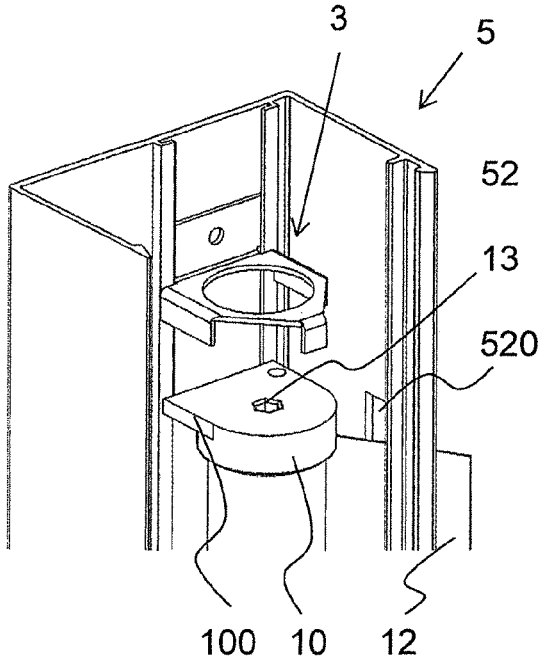
FIG. 8 shows a perspective view of a detail of the finger protection device according to FIG. 6.
Figure 9:
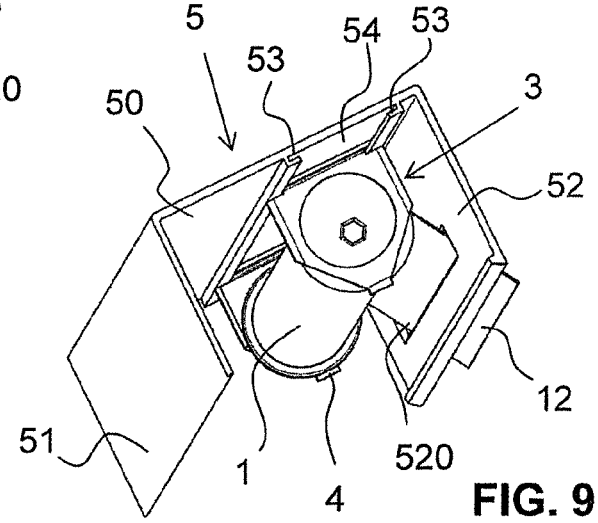
FIG. 9 shows a further perspective view of a detail of the finger protection device according to FIG. 6.

FIGS. 6 and 8 in each case show two first and second holders, wherein the holders with the reference symbols 3' and 4' are simply to show how the holders 3, 4 are fundamentally displaceable along the parallel groove 53.

A side window 520, preferably a slot, through which the roller blind web 12 to be unwound is guided, is present in the second side wall 52. The fastening profile 5 consequently forms a housing for the remaining device, in particular for the housing-free winding roller.

Figure 10:
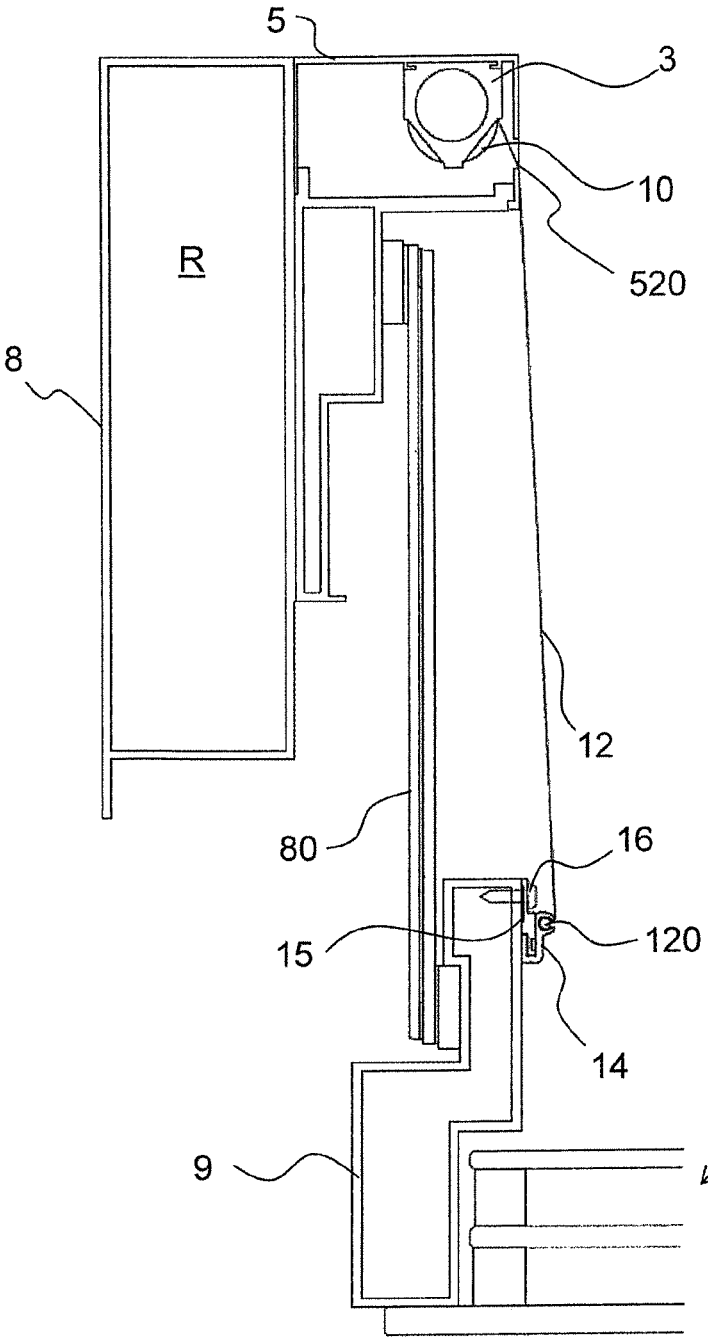
FIG. 10 shows a view of the finger protection device according to FIG. 6 when used in a parallel vent window.
Figure 11:
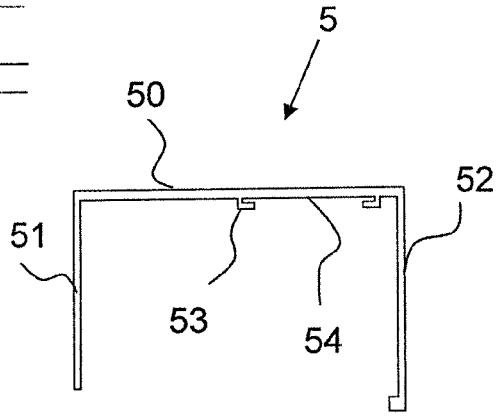
FIG. 11 shows a view of a profile of the finger protection device according to FIG. 10.

FIGS. 10 and 11 show the finger protection device according to the invention in a first application. This is a parallel vent window. The roller blind web 12 can be rectangular for this application, i.e. comprise a constant width over its entire extension length. However, it can also be realized in a triangular form or in another form. The same naturally also applies to other types of application.

FIG. 10 shows a frame R. It preferably consists of a metal profile. It comprises a classic sash frame 8 which is shown here in a simplified manner and without sealing elements. The fastening profile 5 already described above is present integrated in said sash frame or as an attachment part.

A window casement F includes a casement frame 9 which is preferably also realized as a profile element. A scissor-like vent fitting 80 connects the sash frame 8 to the casement frame 9 so that the window casement with its casement frame adjusts outward parallel to itself opposite the sash frame and thus the window is able to be opened by a predefined gap. Such vent fittings 80 are usually arranged on both sides of the casement frame.

A finger protection device according to the invention is arranged then at least in the region of each vent fitting 80.

For this purpose, the fastening profile 5, as already described above, comprises the parallel groove 53 in which the two holders 3, 4 are arranged and thus clamp the winding roller 1 with its two covers 10, 11 between them. The roller blind web 12 is guided through the slot 520.

The free end of the roller blind web 12 is provided with a beading 120 or another stiffener. Said free end can be fastened in various ways to the window casement F, more precisely to the casement frame 9. Said ways are disclosed in the prior art so that the fastening type shown here is simply to be understood as an example.

The beading 120 is arranged in this example in a mounting rail 14 which extends over the entire width of the roller blind web 12. The mounting rail 14 can be mounted in a fastening strip 15 which is screwed to the casement frame 9. One of the screws 16 used for this purpose can be seen in FIG. 10. For fixing the device, the mounting rail 14 is preferably secured to the fastening strip 15 by means of grub screws.

When the window is opened, the roller blind web 12 is consequently unwound from the winding shaft and when it is closed, it rolls up again thanks to the restoring spring of the winding roller 1.

Figure 12:
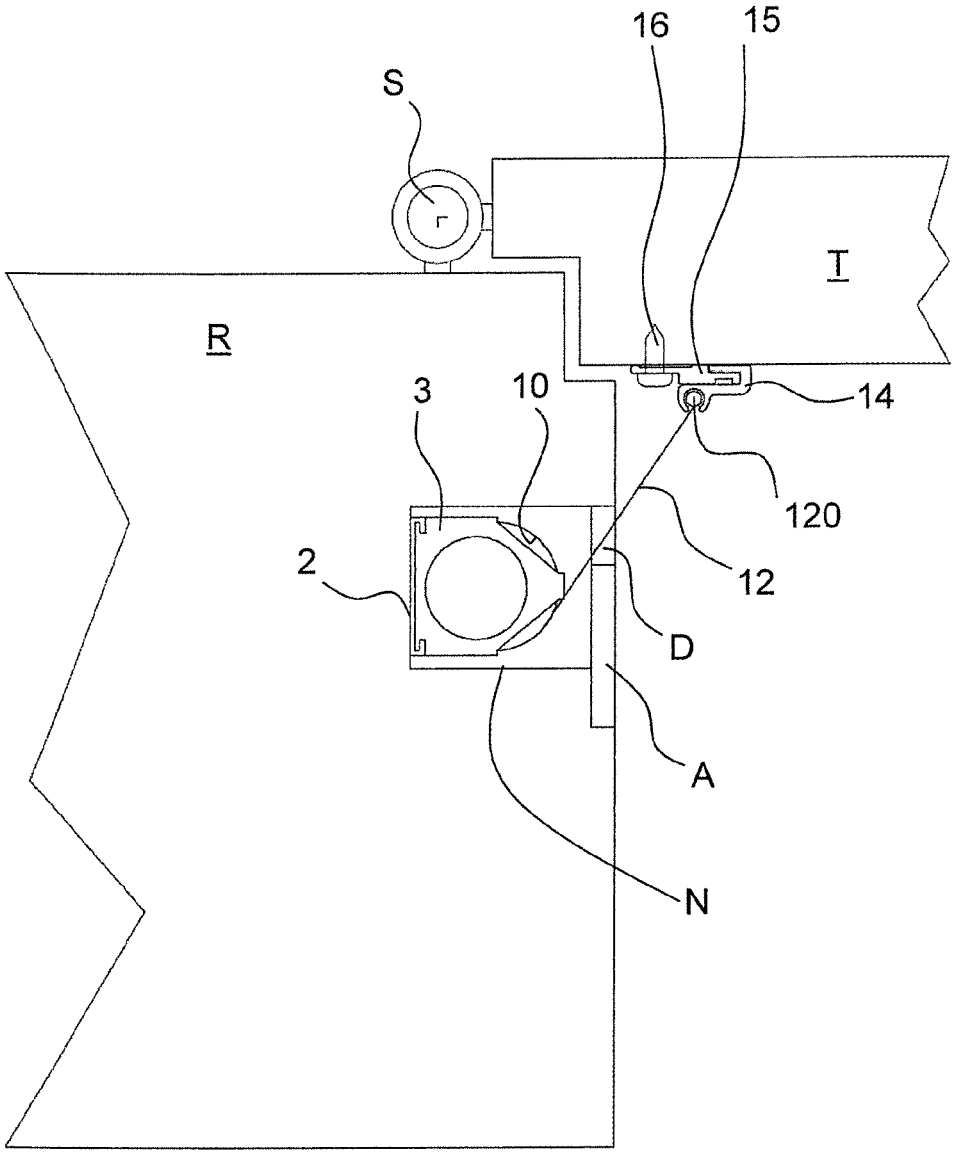
FIG. 12 shows a view of the finger protection device according to FIG. 1 when used in a door, shown with the door leaf closed
Figure 13:
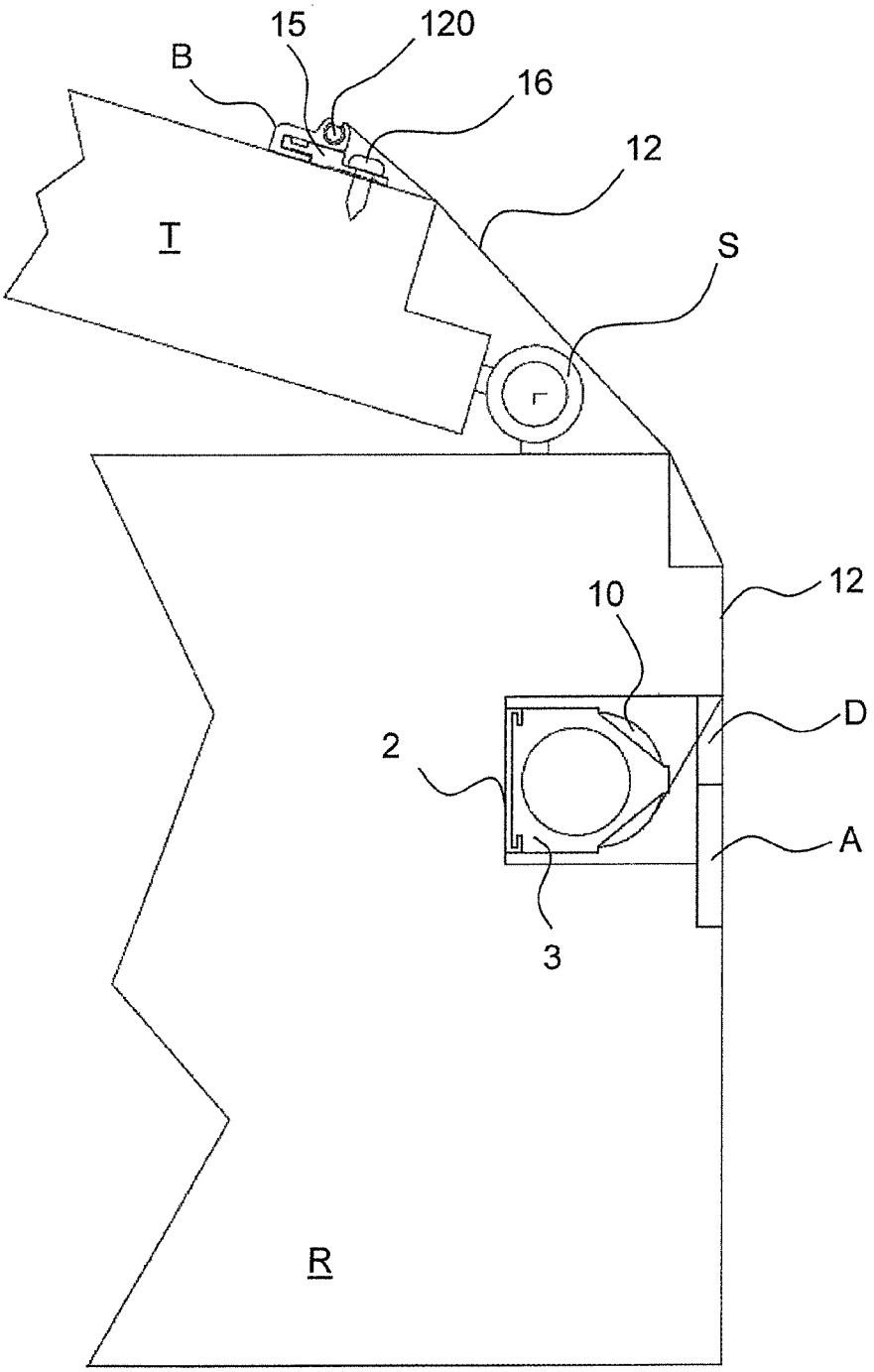
FIG. 13 shows the representation of the application according to FIG. 12 with the door leaf open.

FIGS. 12 and 13 show a different type of application. In this example, the finger protection device serves for the purpose of covering a gap between a door leaf T and a door frame R. The hinge of the door has the reference symbol S. In this example, the door frame R comprises a groove N, in the groove base of which the rail 2 according to the first exemplary embodiment is fastened. The winding roller 1, which has already been described above, is fastened with the covers 10, 11 to the rail 2 by means of the holders 3, 4.

The groove N comprises a cover A which leaves a passage D, preferably a slot, open. The roller blind web 12 is guided through a passage D, wherein it is fastened to the door leaf T in the above-described manner. As can be seen well by looking at both FIGS. 12 and 13, the roller blind web 12 covers the hinge-side gap, i.e. the gap on the secondary closing edge side, which is created when the door leaf T is opened.

The device according to the invention can be used in a diverse manner, can be produced in a cost-efficient manner and requires little space.

The invention claimed is:

1. A finger protection device for bridging a gap of a building opening, the building opening being a door, a window, a gate or a hatch, wherein the building opening comprises a leaf to close the building, wherein the building opening has a first part and a second part, wherein the finger protection device comprises a winding shaft with an end-face first end and an end-face second end and a roller blind web which is windable about said winding shaft by means of the winding shaft, wherein the roller blind web is arranged by way of a first end on the winding shaft and is fastenable together with the winding shaft to the first part of the building opening, thereby defining a winding shaft side, and wherein the roller blind web is fastenable to the second part of the building opening by way of a second end, wherein the finger protection device comprises a first and a second holder, wherein the first holder is arranged on the end-face first end of the winding shaft and the second holder is arranged on the end-face second end of the winding shaft, wherein the first holder encompasses the end-face first end and the second holder encompasses the end-face second end, wherein the first and the second holders serve together for fastening the finger protection device on the winding shaft side to the first part of the building opening, wherein a rail is present, the rail extending in a longitudinal direction of the winding shaft and the rail being fastenable to the first part of the building opening or being an integral component part of the first part of the building opening, wherein the first holder and the second holder are held in the rail, wherein the first holder is displaceable in the rail in the longitudinal direction of the winding shaft in a guided manner relative to the second holder, wherein a position of the first holder is fixable for fastening the finger protection device, wherein the winding shaft is held in a clamped manner between the first holder and the second holder, wherein the first or the second holder comprises a base plate for abutment against the winding shaft and a leg which is arranged at an angle on the base plate for fastening to the first part of the building opening, wherein the base plate comprises a window which forms an access to a spindle of the winding shaft, and wherein the wound roller blind web forms an outermost surface, as a result of which the finger protection device is realized to be used without a housing in the first part of the building opening.

2. The finger protection device as claimed in claim 1, wherein the second holder is also displaceable in a guided manner in the rail relative to the first holder.

3. The finger protection device as claimed in claim 1, wherein the first and the second holder comprise a base plate each for abutment against the winding shaft and a leg each of which is arranged at an angle on the base plate for fastening to the first part of the building opening.

4. The finger protection device as claimed in claim 3, wherein the base plate comprises a window which forms an access to a spindle of the winding shaft.

5. The finger protection device as claimed in claim 1, wherein the first and the second holders are displaceable along a longitudinal groove in order to clamp the winding shaft between them.

6. The finger protection device as claimed in claim 5, wherein the longitudinal groove is arranged in a rail and the leg of the first and the second holder is guided so as to be displaceable in the longitudinal groove.

7. The finger protection device as claimed in claim 1, wherein the winding shaft comprises a cover on at least one end face and wherein one of the two holders encompasses said cover.

8. The finger protection device as claimed in claim 7, wherein the respective holder encompasses the respective cover in a non-rotatable manner.

9. The finger protection device as claimed in claim 7, wherein the respective holder comprises an at least partially circumferential apron for encompassing the respective cover.

10. The finger protection device as claimed in claim 1, wherein the winding shaft comprises a cover on each of the two end faces and wherein each one of the two holders encompasses each one of the two covers.

11. The finger protection device as claimed in claim 10, wherein the respective holder encompasses the respective cover in a non-rotatable manner.

12. The finger protection device as claimed in claim 10, wherein the respective holder comprises an at least partially circumferential apron for encompassing the respective cover.

13. The finger protection device as claimed in claim 1, wherein the first or the second holders is displaceable along a longitudinal groove in order to clamp the winding shaft between them.

14. The finger protection device as claimed in claim 13, wherein the longitudinal groove is arranged in a rail and the leg of the first or the second holder being displaceable along the longitudinal groove is guided so as to be displaceable in the longitudinal groove.

* * * * *